US006234948B1

(12) United States Patent
Yavilevich

(10) Patent No.: US 6,234,948 B1
(45) Date of Patent: May 22, 2001

(54) COMBINED CENTRIFUGATION ASSEMBLY

(76) Inventor: Michael Yavilevich, Haim Street 5, #4, 27076 Kiriat Bialik (IL)

( * ) Notice: Subject to any disclaimer, the term of this patent is extended or adjusted under 35 U.S.C. 154(b) by 0 days.

(21) Appl. No.: 09/509,361

(22) PCT Filed: Oct. 18, 1998

(86) PCT No.: PCT/IL98/00503

§ 371 Date: Mar. 24, 2000

§ 102(e) Date: Mar. 24, 2000

(87) PCT Pub. No.: WO99/21658

PCT Pub. Date: May 6, 1999

Related U.S. Application Data

(60) Provisional application No. 60/063,300, filed on Oct. 27, 1997.

(51) Int. Cl.[7] ..... B04B 5/02
(52) U.S. Cl. ..... 494/20; 494/37
(58) Field of Search ..... 494/12, 20, 33, 494/37, 38, 84, 85

(56) References Cited

U.S. PATENT DOCUMENTS 3,951,334 * 4/1976 Fleming et al. .
4,068,798 * 1/1978 Rohde .
5,045,047 * 9/1991 Hutchins et al. ..... 494/20
5,178,602 * 1/1993 Wells .
5,456,652 * 10/1995 Eberle .
5,584,790 * 12/1996 Bell et al. ..... 494/37
5,588,946 * 12/1996 Graham et al. ..... 494/20
5,707,331 * 1/1998 Wells et al. ..... 494/20
5,851,170 * 12/1998 Howell ..... 494/20

FOREIGN PATENT DOCUMENTS

3512848 * 10/1985 (DE) .
2270 * 6/1979 (EP) .
564834 * 10/1993 (EP) .
81/01255 * 5/1981 (WO) .

* cited by examiner

*Primary Examiner*—Charles E. Cooley
(74) *Attorney, Agent, or Firm*—Thomas M. Freiburger

(57) ABSTRACT

A centrifugation assembly and a method for rapid separation of phases of a liquid, for example for blood phase separation, which comprises a rotor (10) with a holding member (12) pivotable with respect to the rotor about a pivoting axis and containing a tube (16) with a blood sample (18). The assembly comprises a device for rotating the rotor about the rotor axis and a displacing mechanism (24) to displace the common center of gravity of the holding member with the sample with respect to the pivoting axis. A stopping mechanism (22) is provided to retain the degree of inclination of the holding member during the first phase of separation. After completing the first phase of separation, the holding member takes a horizontal position to enable alignment of centrifugal force with the walls of the tube. The centrifugation assembly may have a removing device (172) for removing the caps (168) from the tubes (16) residing within the holder (102).

35 Claims, 12 Drawing Sheets

FIG.9

COMBINED CENTRIFUGATION ASSEMBLY

This application claims the benefit of International Application PCT/IL98/00503, filed Oct. 18, 1998, which was based on provisional application No. 60/063,300, filed Oct. 27, 1997.

TECHNICAL FIELD

The present invention refers to phase separation in liquids. More particularly the present invention relates to methods and devices for centrifugation of blood to achieve phase separation.

BACKGROUND ART

There have been developed various combined separation systems for rapid phase separation. Certain attempts have been made to make use of the so called "Boycott" effect, which requires inclination of the tube walls at a certain angle to the vector of the centrifugation force in order to make the phase separation more efficient. An example of a system employing the Boycott effect is described in the article "Automated Centrifuge Technology"—Laboratory Automation News—vol. 1 No. Oct. 4, 1996. The device described in this article employs switchable cam-like mechanism for displacement the tube during centrifugation.

There are known also other centrifugation assemblies utilizing the Boycott effect, e.g. as disclosed in U.S. Pat. No. 5,584,790 assigned to Beckman Instruments Inc.. This assembly employs a spring-loaded linkage system for inclination holders carrying the tubes and thus to misalign the tubes with the vector of the centrifugation force.

The other example of a centrifugation assembly employing the Boycott effect can be found in U.S. Pat. No. 5,588,946 assigned to Johnson & Johnson Clinical Diagnostics, Inc. In this assembly a patient sample tube is spun while non-aligned with the centrifugation force to allow phase separation and then while aligned to allow any gel present between the separated phases to seal.

Unfortunately the constructions of the above assemblies are not suitable for implementation in a conventional swing-out bucket centrifuge in which a large number of tubes should be rotated. Furthermore the assemblies mentioned above are not capable of developing sufficient phase separation in large number of sample tubes.

DISCLOSURE OF THE INVENTION

This invention relates to an assembly and a method for rapid phase separation in liquids in general and for blood phase separation in particular. The invention can be implemented either in ordinary swing-out rotor centrifuges, in high-speed centrifuges and in Automatic Laboratory Systems.

The method of the present invention comprises spinning the tubes with blood samples while they are inclined to make use of the Boycott effect for more rapid phase separation. In the second stage of separation the tubes spin while their longitudinal axes are aligned with the direction of the centrifugation force to allow reliable gel seal.

In accordance with the method of the invention the position of the common centre of gravity of the holders and of the tubes placed therein is varied during the separation process. The first position of the common center of gravity is above the pivoting axis of each holder. By virtue of this provision the centrifugal force can not pivot the holders with tubes in ordinary horizontal position. The degree of inclination of the holders is maintained by a stopping means having various construction as it will be disclosed further. The stopping means can be individual for each holder or common for all holders. The stopping means can be formed integrally with the holder or with the centrifuge rotor or with the other parts of the centrifuge. The common stopping means may be placed in the middle of the rotor. The collapsible and revolving stopping means also can be used and are operated electromagnetically or manually.

After completing the first stage of the separation accompanied by the Boycott effect the common center of gravity is displaced in the second position, i.e. under the pivoting axis of the holder. During the second stage the centrifugal force urges the holders with tubes to pivot into horizontal position in which they could have been aligned with the vector of the centrifugation force and thus the complete gel seal can take place. The stopping means does not prevent this pivoting movement. In the end of the second stage the centrifuge is stopped and the holders and tubes return back into the initial position.

According to the present invention in the beginning of centrifugation the common center of gravity of the holders, including tubes, specimens and gel is above the pivoting axis of the holder. After performing the first stage of separation accompanied by the Boycott effect the common gravity center is displaced below the pivoting axis.

According to the alternative method of the present invention in the beginning of centrifugation the common center of gravity of the holders, including tubes, specimens and gel is below the pivoting axis of the holder. After performing the first stage of separation accompanied by the Boycott effect the common gravity center is displaced below its first position.

The holders may include displacement means to vary the location of the gravity center during centrifugation. Various embodiments of the centrifugation assembly of the present invention are summarized below.

In the first embodiment the assembly comprises:

- a rotor with a holding means for carrying at least one tube, said tube containing a blood sample and a gel separator, said holding means being pivotable with respect to the rotor, the position of the common center of gravity of the holders and of the tubes placed therein is varied during the separation process,
- a means for rotation the rotor about a rotor axis to produce a centrifugal force having its vector radiating from the rotor axis, said centrifugal force is capable:
  - a) to induce phase separation due to the Boycott effect when the tube is pivoted in the first position in which the tube walls are inclined with respect to the vector of the centrifugal force and
  - b) to allow complete gel seal when the tube is pivoted in the second position in which the tube walls are aligned with the vector of the centrifugal force,
- a displacing means for displacing the common center of gravity of the holding means together with the tube carried thereby from a first location situated above the pivoting axis into a second location situated below the pivoting axis,
- a stopping means for maintaining a degree of inclination of the tube when it is pivoted in the said first position.

The assembly may comprise a swing-out bucket centrifuge, while said rotor carries a yoke for mounting the holding means thereon and said holding means comprises at least one bucket preferably equipped with an adapter for inserting the tube there into, said bucket is mounted on the yoke with possibility for swinging with respect to the yoke.

The centrifugation assembly may comprise also a high-speed centrifuge.

The centrifugation assembly may comprise a displacing means formed as a closed cylindrical container, said container being insertable within the holder, said container being filled with a fluid capable to flow from one extremity of the container to the opposite extremity thereof, said fluid being selected from the group comprising viscous liquids, suspensions, loose particles or their combination.

The said container may be formed with a narrowing central portion. The container may be provided with a partition and channels, said partition is fixedly secured in the middle part of the container.

The container may comprise a spring loaded piston movable along the container and a spherical valve, said valve is fixedly secured opposite to the piston in the middle part of the container, said valve has through going channels for flowing the fluid there through.

The container may comprise a free mass placed therein with the possibility to move along the container, the outside diameter of the mass is less than the inside diameter of the container and there is provided a gap there between, said gap is sufficient for flowing the fluid there through.

The mass may be provided with a valve and with through going channels, said channels are closed from one side of the mass by a valve and are open from the opposite side of the mass, said container having a spring means urging the mass to return from the lowermost extremity of the container to the uppermost extremity thereof, said container has a retaining means to retain the mass proximate to the uppermost extremity of the container.

The stopping means of the assembly may comprise a support, said support is formed integrally with the external portion of the bucket or its cap, said support is capable to lean against the rotor when the bucket is pivoted in the said first position so as to maintain the degree of inclination of the tube.

The stopping means may comprise a support, said support is formed integrally with the rotor, said support is capable to lean against the bucket when the bucket is pivoted in the said first position so as to maintain the degree of inclination of the tube.

The stopping means may comprise a support, said support is formed integrally with the upper portion of the adapter, said support protrudes therefrom towards the rotor, said support is capable to lean against a circular protrusion formed on the rotor when the bucket is pivoted in the said first position so as to maintain the degree of inclination of the tube.

The stopping means may comprise a bracket, said bracket embraces the bucket, said bracket is pivotally mounted on the yoke and said bracket is formed with a support capable to lean against the yoke when the bucket is pivoted in the said first position so as to maintain the degree of inclination of the tube.

The said stopping means may comprise a cam, said cam is mounted on the rotor with possibility for displacement within a plane directed perpendicular to the rotor axis, said cam is provided with at least one contact surface capable to lean against the bucket when the bucket is pivoted in the said first position so as to maintain the degree of inclination of the tube.

The stopping means may also comprise at least one linking arm and operatively connected therewith extension rod, said arm is pivotally connected to the yoke so as to swing with respect thereto together with the bucket, said bucket has a slot for placement said arm there into and said extension rod is connected to a load mounted on the rotor, said load is displaceable along the rotor axis so as to pivot the arm, said arm is capable to lean against the slot when the tube is pivoted so as to maintain the degree of inclination of the bucket when it is pivoted in accordance with the position of the load.

The stopping means may comprise a resilient wire element, the first portion thereof is configured to embrace the bucket, the middle portion thereof is provided with at least one turn for mounting the wire element on the yoke to enable swinging with respect thereto and the opposite portion of the wire element is capable to lean against the yoke when the bucket is pivoted in the said first position so as to maintain the degree of inclination of the tube.

The stopping means may comprise a resilient wire element, the first portion thereof is rigidly secured on the yoke, the middle portion thereof is provided with at least one turn suitable for mounting the wire element on the yoke to enable swinging with respect thereto and the opposite portion of the wire element is inserted within a slot formed on the bucket, the opposite portion of the wire element is capable to lean against the slot when the bucket is pivoted in the said first position so as to maintain the degree of inclination of the tube.

The stopping means may comprise a toothed sector, said sector is mounted on the yoke, said sector has a protrusion with possibility for swinging with respect to the yoke together with the bucket and said bucket has a slot for receiving said protrusion, the protrusion is capable to maintain the degree of inclination of the bucket when the tube is pivoted in the said first position.

The centrifugation assembly may comprise a displacing means formed integrally with the holder, said means may as well comprise a cylindrical container formed with the annular closed interior, said interior contains a fluid capable to flow from one extremity of the container to the opposite extremity thereof, the diameter of the middle portion of the container fits the outside diameter of the tube adapter to allow inserting thereof in the container and to enable pivoting of the tube together with the container, the stopping means comprises at least one support mounted on the rotor and capable to lean against the outside surface of the container when the tube is pivoted in the said first position so as to maintain the degree of inclination of the tube.

The said holder may be provided with a removing means for removing the caps from the tubes residing within the holder.

The removing means may comprise

- a removable insert which is fixed on the upper part of the holder, said insert is provided with a perforated partition, the diameter of perforations of the partition fits the outside diameter of the tubes so as to allow insertion of the tubes within the adapter through the perforations,
- a support plate for supporting the tubes after they are inserted in the adapter, said plate movable by the centrifugal force along the longitudinal axis of the bucket from its uppermost position to the lowermost position,
- a fixing means capable to prevent displacement of the tubes by the centrifugal force from the uppermost position towards the lowermost position when the bucket is pivoted in the first position,
- a spring means for returning the tubes from the lowermost position into the uppermost position, the arrangement being such that the tubes are movable by the centrifugal force towards the lowermost position until their caps lean against the partition so as to be removable from the tubes. The fixing means may be electromagnetically controlled.

The centrifugation assembly may comprise a displacing means formed integrally with the adapter, said means may as well comprise a free mass placed within the adapter with the possibility to move there along from one extremity of the adapter to the opposite extremity thereof, the outside diameter of the mass is less then the inside diameter of its compartment and there is provided a gap there between, said gap is sufficient for flowing the fluid there through.

The adapter can be provided with a spring capable to return the mass from one extremity of the adapter to the opposite extremity thereof.

The other group of embodiments refers to a method for sample phase separation by virtue of a centrifugation of a sample within a tube, said method comprising the following sequence of steps:

a) providing at least one tube with the blood sample and the gel separator, b) placing said tube within a centrifugation assembly having a rotor and a holding means for carrying the tube, said tube is placed in the holder with possibility for pivoting together with the holding means with respect to the rotor about a pivoting axis, the position of the common center of gravity of the holders and of the tubes placed therein is varied during the separation process, c) rotation of the rotor about a rotor axis to produce a centrifugal force having its vector radiating from the rotor axis, d) effecting blood phase separation in the sample due to the Boycott effect when the tube rotates about the rotor and is pivoted in the first position in which the tube walls are inclined with respect to the vector of the centrifugal force, e) displacing the common center of gravity of the holding means and the tube carried thereby from a first location situated above the pivoting axis into a second location situated below the pivoting axis, f) maintaining the degree of inclination of the tube while the tube rotates being pivoted in the first position, g) effecting complete gel seal when the center of gravity is displaced below the pivoting axis while the tube rotates being pivoted in a second position in which the tube walls are aligned with the vector of the centrifugal force.

In the said the centrifugation can be effected by a conventional swing-out bucket centrifuge or by a high-speed centrifuge.

Displacing of the common center of gravity can be done in this forms:

a) by displacing a fluid inside a closed container, which is placed in the holder, b) by displacing a free mass inside the holding means, c) by displacing the tubes and/or the adapter inside the bucket, d) by displacing the heavy parts of the sample (sediment) inside the tubes.

The flow of the fluid within the container can be effected in a controllable manner.

The present invention in its various embodiments referring to the different groups above has only been summarized briefly.

For better understanding of the present invention as well of its benefits and advantages reference will now be made to the following description of its embodiments taken in combination with the accompanying drawings.

BEST MODE FOR CARRYING OUT THE INVENTION

Figure 1B:
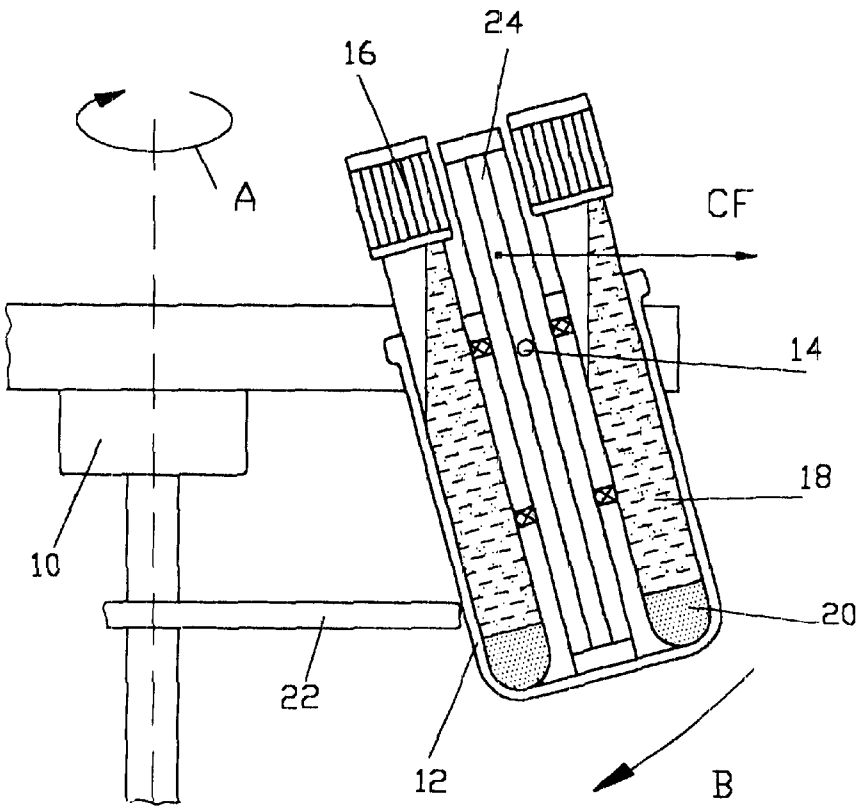
FIGS. 1*a*, 1*b*, 2*a*, and 2*b* show schematically the principle of operation of the assembly of the present invention.
Figure 1A:
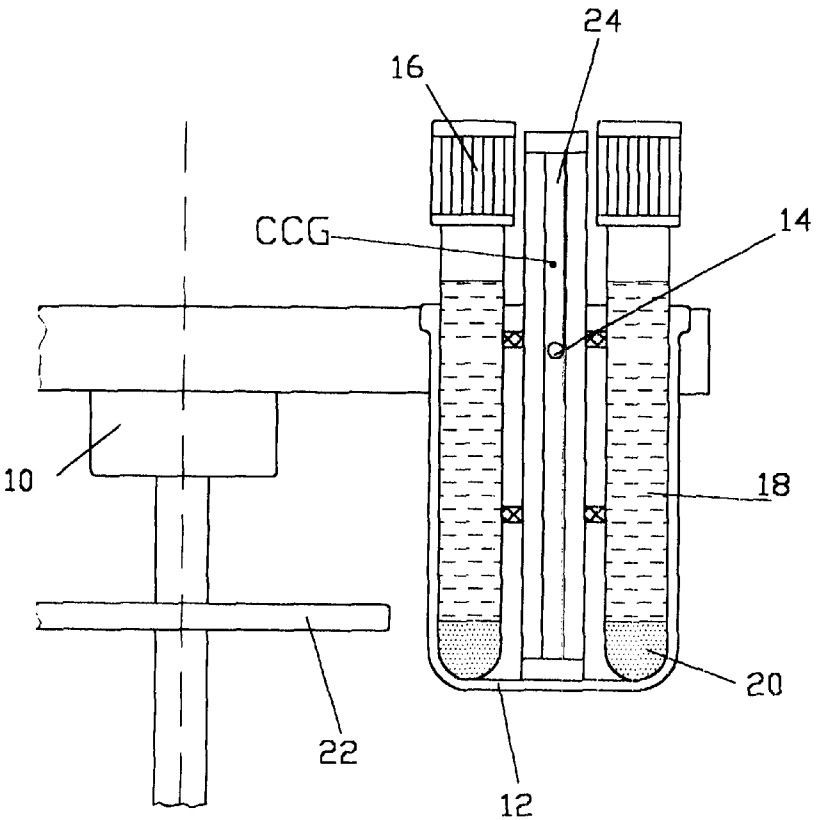

With reference to FIGS. 1*a*–*b* and 2*a*–*b* the principle of the present invention will be briefly explained. A rotor 10 of a centrifugation assembly for sample phase separation, for example a swing-out bucket centrifuge is rotatable by a rotation means for example a motor (not shown) and carries a holding means, for example a bucket 12, which is pivotable with respect to a pivoting axis 14. Within the holding means is contained at least one sample tube 16 with a blood sample 18 and a gel separator 20. The sample tubes can be inserted within an adapter. The common center of gravity of the holding means and of the tubes carried by the holding means is designated as CCG and in the beginning of the centrifugation process it is situated above the pivoting axis 14. By virtue of this provision the vector of centrifugation force CF developed once the rotor 10 is rotated in the direction of an arrow A, will urge the holding means and the tubes contained therein to pivot in the direction of an arrow B, as shown in FIG. 1*b*. In order to overcome the influence of the centrifugation force there is provided a stopping means 22, for example a support, which protrudes towards the holding means and urges thereof to be inclined. By virtue of this provision the holding means becomes inclined as shown in FIG. 1*b*. Seeing that in this position the tube walls are inclined with respect to the vector of centrifugation force CF there are provided favorable conditions for the process of phase separation by virtue of the Boycott effect. In the further disclosure the location of the common center of gravity CCG above the pivoting axis 14 will be referred to as a first location. This location corresponds to that position of the tube 16 in which its walls are inclined with respect to the vector CF and the degree of this inclination is maintained. The corresponding position of the tube will be referred to as a first position.

Figure 2B:
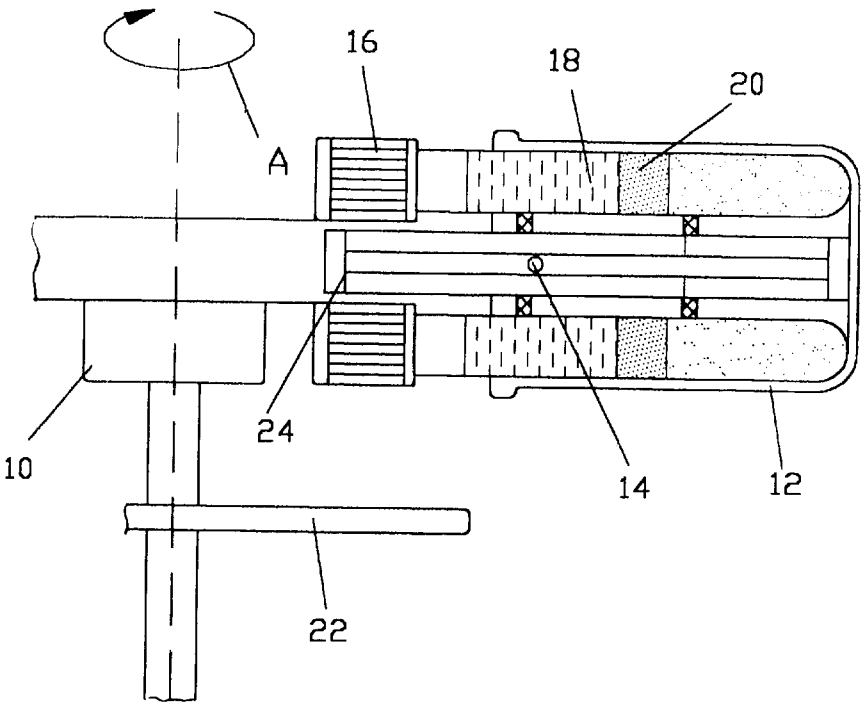
Figure 2A:
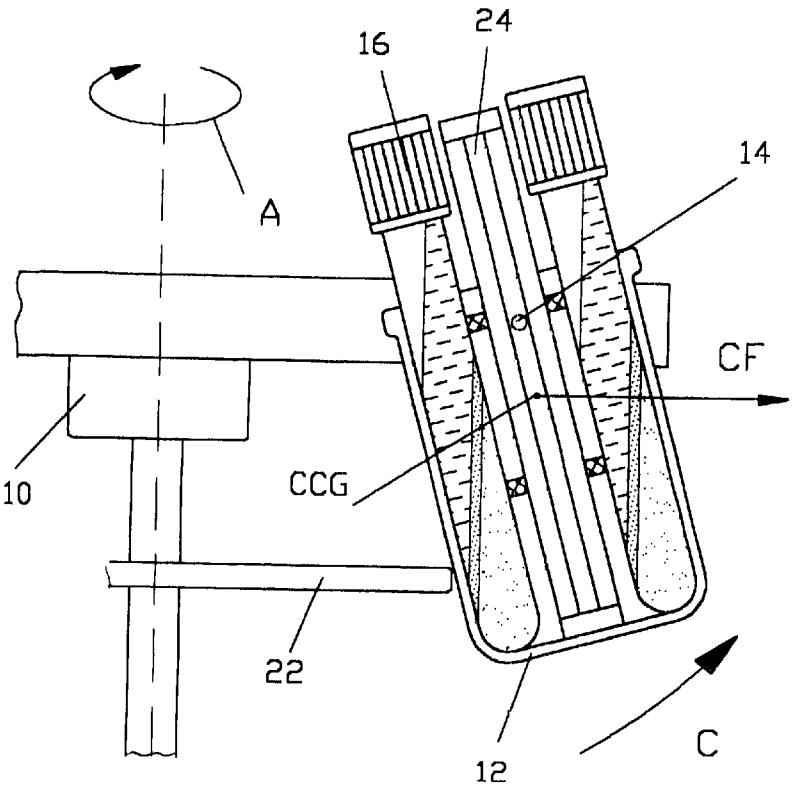

In accordance with the invention simultaneously with the process of phase separation the common center of gravity CCG of the holding means and of the tube is gradually displaced from the first location to a second location below the pivoting axis 14. This condition is shown in FIG. 2*a*. In this location a gel seal is developed and the process of-phase separation due to the Boycott effect is completed. Since the common center of gravity CCG is below the pivoting axis 14 the centrifugation force CF urges the holding means to pivot in the direction as shown by an arrow C until the bucket 12 with the tube 16 takes the horizontal position as shown in FIG. 2*b*. It can be readily appreciated that the stopping means does not prevent pivoting of the holder in this direction. In the horizontal position the tube walls are aligned with the vector of centrifugation force and in this position there are provided most favorable conditions for the complete gel seal and formation of a gel layer 20 reliably separating between the blood phases. The location of the common center of gravity CCG below the pivoting axis 14 will be referred to further as the second location and the position of the tube 16 in which its walls are aligned with the vector of the centrifugal force CF will be referred to as the second position.

For displacing the common center of gravity CCG there is used a dedicated displacing means, formed as an elongated container 24, which is inserted together with the sample tubes 16 within the adapter of the bucket 12 and in which the displacement of its center of gravity is induced by the centrifugal force.

In FIGS. 3*a*–5*b* there are shown various embodiments of the displacement means.

Figure 3D:
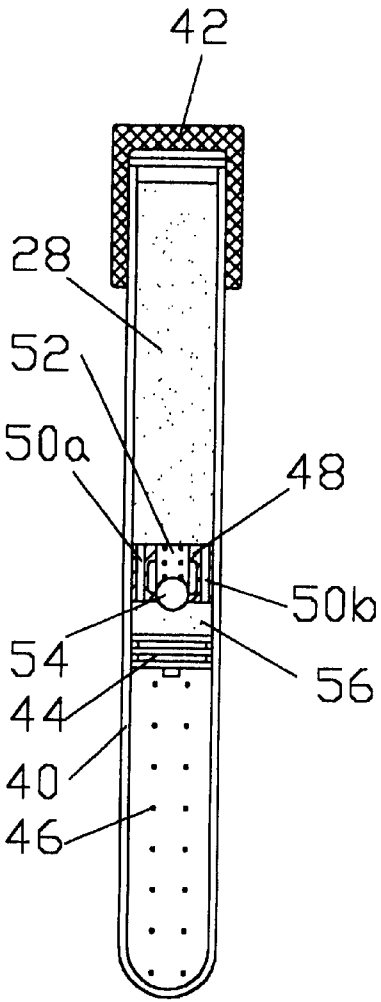
FIGS. 3*a*–5*b* are various embodiments of the displacement means intended for displacing the common center of gravity of the holder with the tube inside.
Figure 3C:
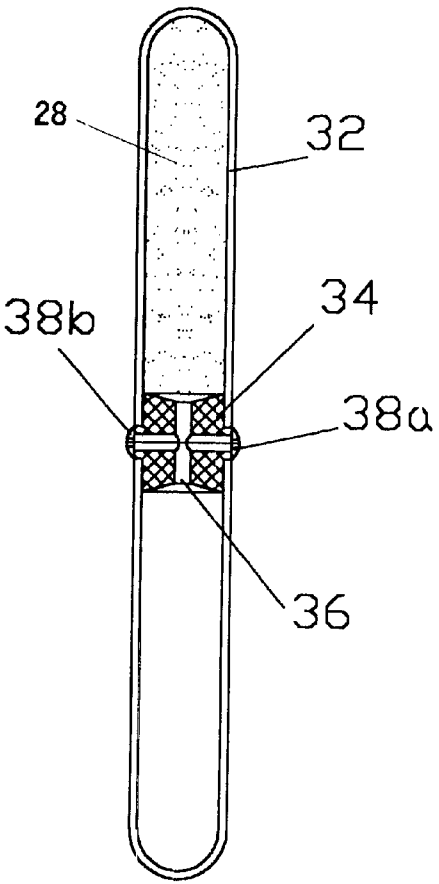
Figure 3B:
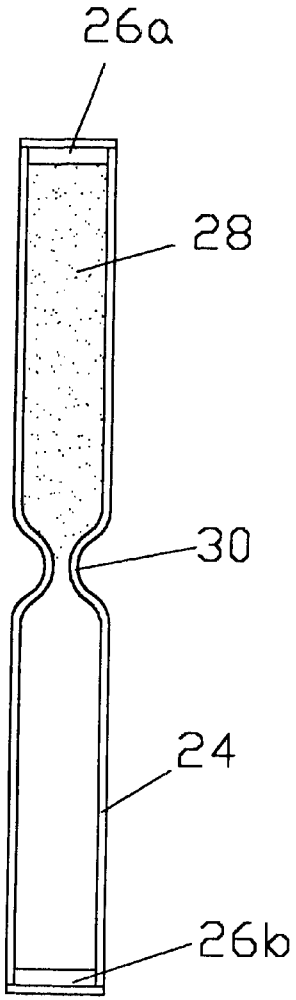
Figure 3A:
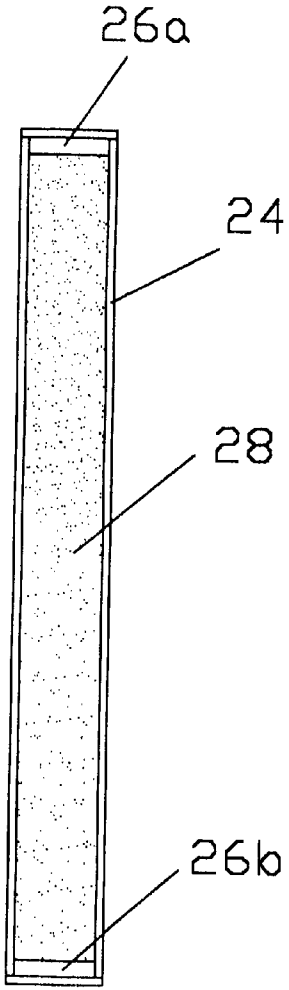

With reference to FIG. 3*a* the displacing means is formed as an elongated container 24, configured for example as a cylinder with the outside diameter similar to that of the sample tubes so as to enable insertion of the displacement means within the holding means.

The interior of the container is reliably sealed at its first extremity and at its opposite extremity by a coverings 26*a*–*b*. The interior of the container is filled with a suspension 28. It can be appreciated that due to the sedimentation in the suspension the center of gravity of the container is displaced and therefore once such container is inserted into the holding means the location of its center of gravity will be displaced as well.

Once the center of gravity of the container is displaced from the upper extremity of the container into the opposite extremity, the container should be removed from the bucket and turned over so as to enable use of the displacing means once again in the next run of the centrifugation process.

With reference to FIG. 3*b* the container 24 can be provided with a narrowing central portion 30 or be provided with the other flow control means as it will be explained further. It can be appreciated that the narrowing portion 30 functions as a throttle, which influences the flow of the fluid and thus controls the dynamics of the displacement of the center of gravity. The interior of the container is filled with a fluid 28 capable to flow from the first extremity of the container to the second extremity.

As a suitable fluid one can use a viscous liquid, e.g. an oil, a suspension or plurality of loose particles. The specific weight and the viscosity of the fluid should be chosen empirically so as to enable efficient displacement of the common center of gravity of the holding means with the sample tubes inside.

Once the fluid has flowed from the upper extremity of the container into the opposite extremity the container should be removed from the bucket and turned over so as to enable use of the displacing means once again in the next run of the centrifugation process.

In FIG. 3*c* is shown another embodiment of the displacing means formed as an elongated sealed ampule 32. Within the ampule 32, in the middle part thereof there is fixedly secured a partition 34, having a through going channel 36. The diameter of the channel 36 can be varied by a couple of screws 38*a*–*b*. The fluid 28 flows from the upper extremity of the ampule down, goes through the channel and fills the opposite extremity. Then the ampule is removed from the bucket, is turned over and inserted into the bucket again for the next centrifugation run.

In FIG. 3*d* there is shown another embodiment of the displacing means formed as an ampule 40, which is sealed from its bottom end. The upper end of the ampule is closed by a releasable cover 42. Within the ampule there is provided a piston 44 supported by a return spring 46. The piston is movable along the ampule towards its uppermost position by the spring. Above the piston 44 there is fixedly secured a valve 48. The valve is provided with two lateral through going channels 50*a*–*b* and with a central opening 52 closed by a small spring loaded sphere 54. The diameter of the central opening is larger than the diameters of the lateral channels. In the beginning of the centrifugation run the fluid 28 is contained in the upper extremity of the ampule 40 and flows due to the centrifugal force down via the channels 50*a*–*b* to fill the space 56 between the valve 48 and the upper surface of the piston 44. The fluid presses on the piston 44, overcomes the resistance of spring 46 and gradually displaces the piston 44 down towards the sealed end of the ampule 40. In the end of the centrifugation run the spring 46 returns the piston 44 back in its upper most position. The piston 44 urges the fluid 28 contained within the space 56 to flow back to the upper extremity of the ampule. The fluid 28 pushes the spring loaded sphere 54 up to open the opening 52. Since the diameter of the opening 52 exceeds the diameter of the lateral channels 50*a*–*b* the fluid 28 will be flowing fast via the opening 52. Once the fluid 28 has flown from the space 56 into the upper extremity of the ampule the displacing device is ready for the new centrifugation run. It can be appreciated that in this embodiment there is no need to take the displacing device out of the centrifuge so as to turn it over since the fluid is returned by the piston in its initial position automatically.

Figure 4B:
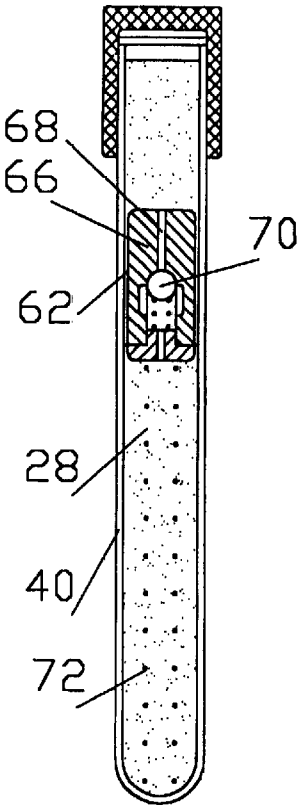
Figure 4A:
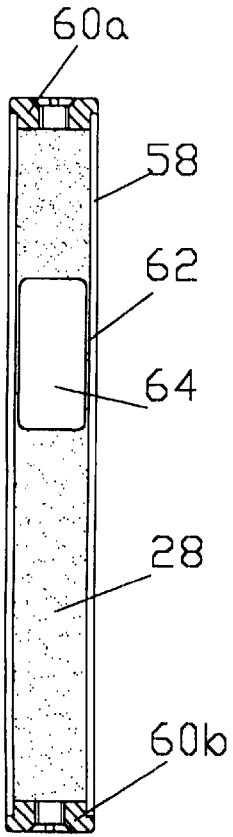

In FIG. 4*a* there is shown an additional embodiment of the displacing means for employing a free mass in the container, which is configured as a cylinder 58. The container is hermetically closed from its opposite ends by removable covers 60*a*–*b*. Within the cylinder 58 there is provided a free mass 64, the outside diameter of which is less than the inside diameter of the cylinder 58 and there is provided a circular gap 62 there between. The width of the gap 62 is sufficient for controllable flow of the fluid 28 via the gap 62.

The mass 64 and thus the center of gravity is displaceable by the centrifugal force towards the opposite extremity of the container. In this position the container 58 is turned over to be ready for the next run.

In FIG. 4*b* there is presented an additional embodiment of the displacing means, which also employs a free mass 66 provided within the container. In this embodiment the container comprises an ampule 40 which is similar to that of the FIG. 3*d*. The free mass 66 is formed as a valve with a central through going channel 68 closed by a spring loaded sphere 70. Between the free mass 66 and the inwardly facing surface of the ampule 40 is provided a circular gap 62 similar to that of the FIG. 4*a*. The mass 66 is supported by a spring 72 capable to return the mass 66 in the uppermost position.

Figure 5B:
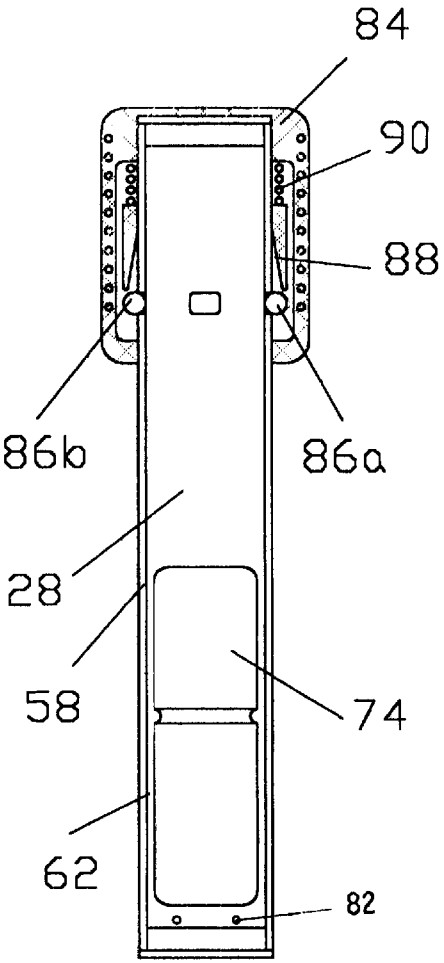
Figure 5A:
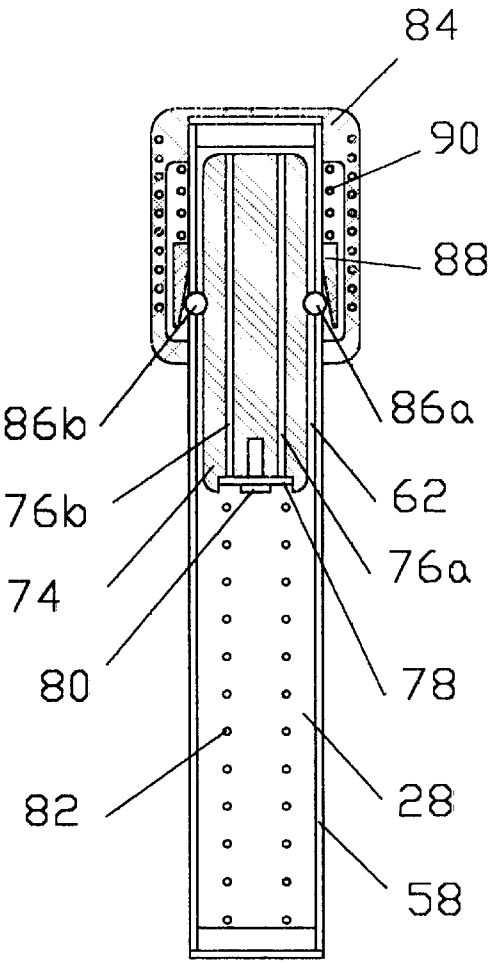

During the centrifugation run the mass 66 is urged by the centrifugal force to move down and to take its lowermost position. The fluid 28 is also urged to flow via annular gap 62. The spring 72 returns the mass 66 from its lower position corresponding to the end of the centrifugation run into the initial position. Simultaneously with the returning of the mass 66 the fluid 28 goes back through the channel 68, since the spring loaded sphere 70 is open. It can be realized that this embodiment also does not require to take the displacing device out of the centrifuge for turning it over since the mass is returned by the spring in the initial position automatically. With reference to FIG. 5*a* and *b* there is shown an embodiment of the displacing means in which the cylindrical closed container 58 is provided with a free mass 74 formed as a valve having a few through going channels 76*a–b* closed by a membrane 78, secured by a screw 80 on the one end of the mass 74. As in the previous embodiments the outside diameter of the mass 74 is less then the inner diameter of the container 58 and there is provided a gap 62 there between to enable controllable flow of the fluid 28 there through. The mass 74 is supported by a spring 82 capable to return the mass 74 along the container 58 from its lowermost position to the initial position. On the upper part of the cylindrical container 58 there is mounted a retaining means 84, for example a solenoid, capable to retain the mass 74 proximate to the upper extremity of the cylinder 58. The retaining means comprises two or more spheres 86*a–b*, which can be pressed by an inwardly facing conical surface of a fixating insert 88 towards the annular groove made on the outwardly facing surface of the mass 74. The fixating insert 88 can be kept in the fixing position by virtue of a spring 90 or relieved therefrom by virtue of a solenoid 84.

The FIG. 5*a* shows how the mass 74 is secured in its uppermost position by the retaining means and therefore can not be displaced by the centrifugal force. In FIG. 5*b* one can see how the mass 74 has been released by the retaining means and displaced by the centrifugal force in the lowermost position. The fluid 28 has flown through the annular gap 62. Now the spring 82 is ready to return the mass in the uppermost position. The fluid 28 will be returning in the initial position via the channels 76. It can be appreciated that this embodiment is also provided with the capability to return automatically the displacing means in the initial condition required for the new centrifugation run and capability to operate the mass 74 by solenoid and timer.

Now with reference to FIGS. 6–8 it will be explained how the degree of inclination of the bucket of the centrifugal assembly is retained in the first position during the phase separation.

Figure 6:
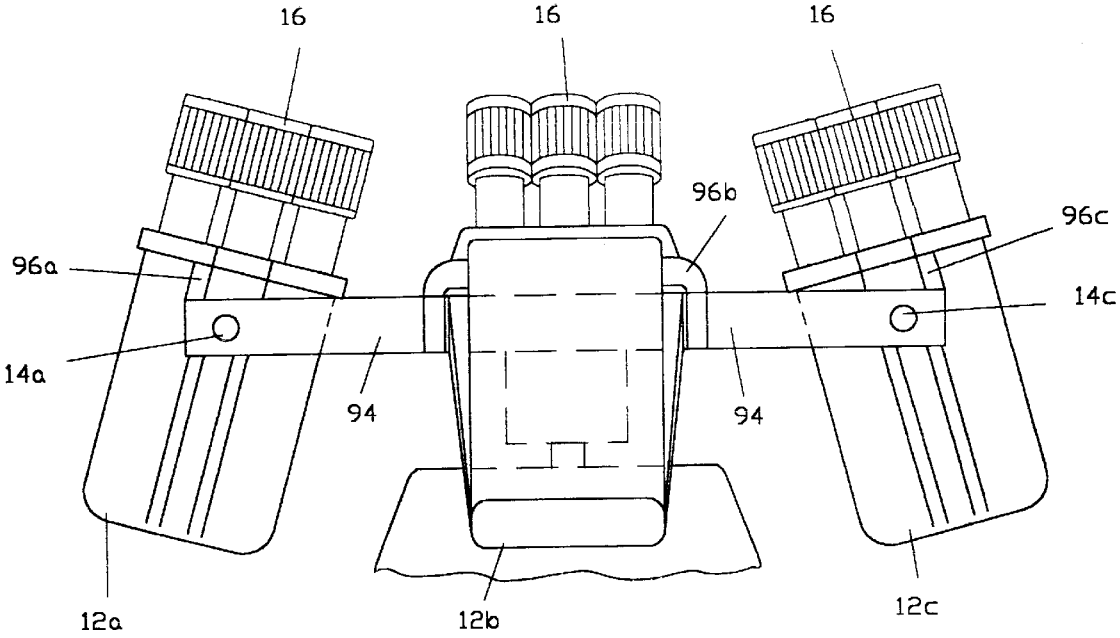
FIGS. 6–8 are various embodiments of a swing-out bucket centrifugation assembly implementing the present invention.
Figure 7:
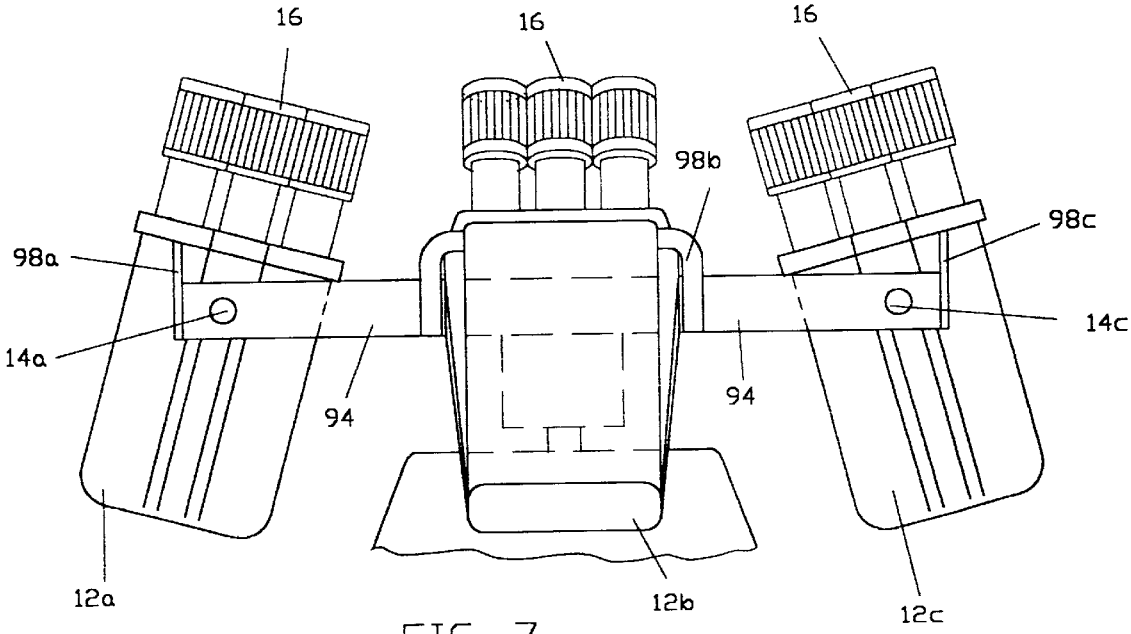

Referring to FIGS. 6 and 7 at least two pair of buckets 12 pivotally mounted on the yoke 94 by virtue of their corresponding pivoting axes 14.

On the FIG. 6 one can see only buckets 12*a–c* and their corresponding pivoting axes 14*a–c*. Within the buckets 12 there are contained adapters (not shown) for inserting there into tubes 16 with blood samples. It is not shown specifically, but should be understood that displacing means are inserted as well into the adapters. The degree of inclination of the buckets 12 is kept by virtue of supports 96*a–c*, which are formed integrally with the upper parts of the corresponding buckets 12. The supports 96 are capable to lean against the yoke 94 and thus to maintain the degree of inclination of the buckets 12. It is not shown but should be understood that supports may be formed integrally with buckets caps or other part of the holding means.

In the embodiment shown in FIG. 7 the assembly is provided with supports 98*a–c* which are formed integrally with the yoke 94 so as to lean against the upper portion of the buckets 12 and thus to keep the degree of their inclination.

Figure 8:
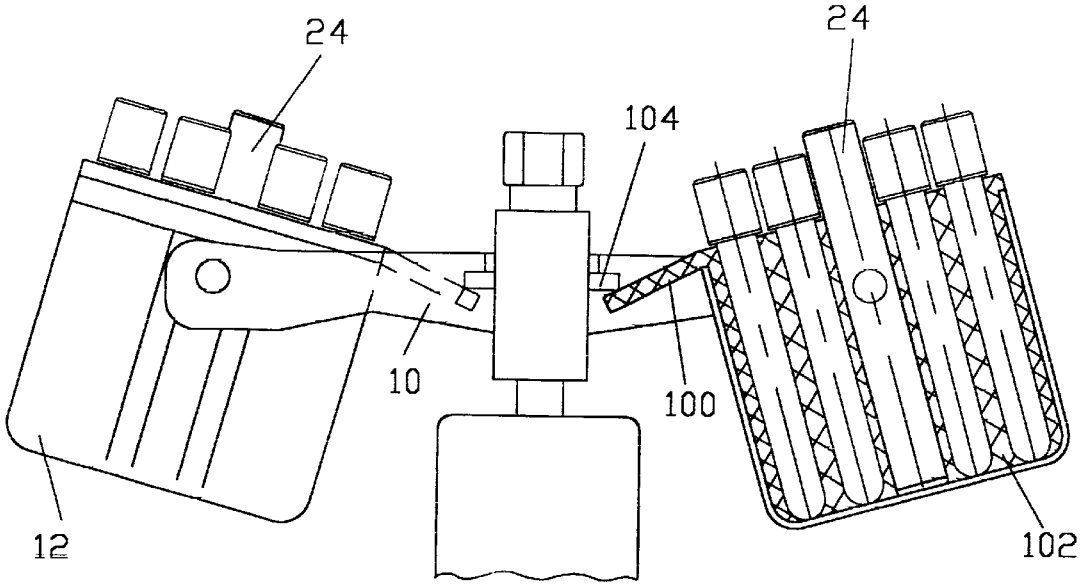

In the further embodiment as presented in FIG. 8 the stopping means 100 is formed integrally with an adapter 102 in which the tubes 16*a–d* are inserted. It can be seen that within the adapter 102 is also inserted a displacing means 24 designed as previously described with reference to any of FIGS. 3–5 above. The stopping means comprises a support lever 100 protruding from the adapter 102 towards the rotor 10 and a protrusion 104 formed on the rotor 10. It can be readily appreciated than when the bucket 12 is inclined as shown in FIG. 8 the support lever 100 of the adapter 102 leans against the protrusion 104 and thus the degree of inclination of the bucket 12 is maintained until the Boycott effect is over.

Figure 9:
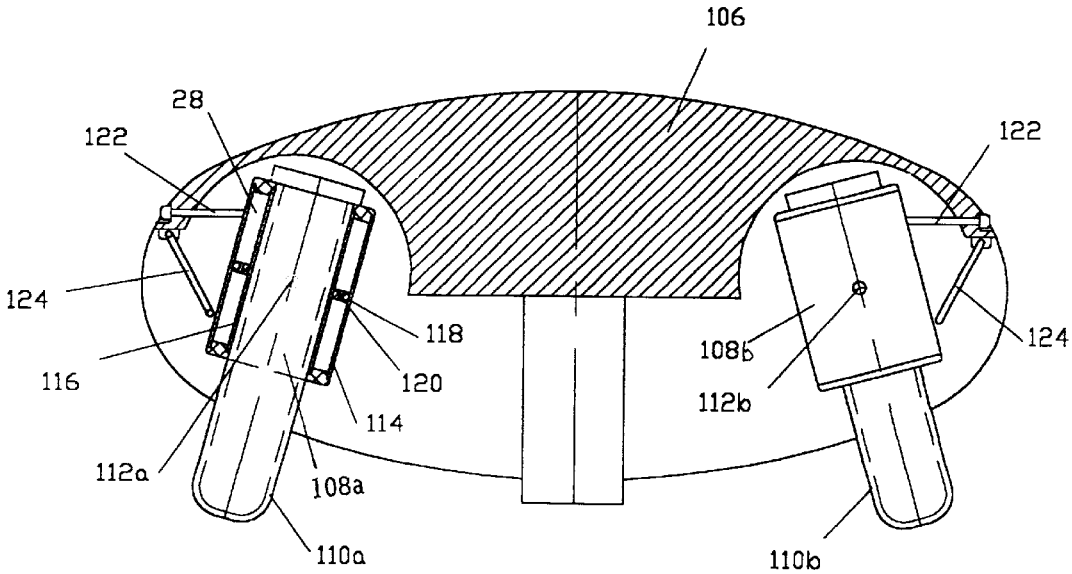
FIG. 9 shows implementing of the present invention in a high-speed centrifugation assembly.

In addition to those embodiments of the assembly which refer to the swing-out centrifuges the present invention can be also implemented in a high-speed centrifuge as shown in FIG. 9. Here the rotor 106 of the assembly carries at least one pair of displacing means 108*a–b*, which function as holders for tubes adapter 110*a–b*. The displacing means 108 can pivot about the pivoting axes 112*a–b* and so the tubes adapters 110. The displacing means 108 comprises a cylindrical member which is defined by an outer cylindrical surface 114 and by an inner cylindrical surface 116. Within the closed circular interior provided between the above cylindrical surfaces there is contained a fluid 28 capable to flow due to the centrifugal force from one extremity of the member to the opposite extremity and thus to displace the common center of gravity of the displacing means 108 and of the tube adapter 110. The inner diameter of the cylindrical surface 116 slightly exceeds the outer diameter of the tubes adapter 110 and so it can be inserted within the displacing means 108.

For improving the flow control in the middle of the circular interior a partition 118 with an opening 120 can be arranged within the circular interior. The opening 120 may be provided with a valve. The valve may be electromagnetically controlled.

The stopping means of the embodiment shown in FIG. 9 comprises a fixed support 122 and a folding support 124. The support 124 retains the displacing means 108 together with the tubes adapter 110 in the inclined position when the assembly does not operate. During the centrifugation process when the Boycott effect takes place the degree of inclination of the displacing means and of the tube is maintained by virtue of the fixed support 122, which leans against the outwardly facing surface of the member 108. After completing the separation run the tubes adapter 110 is removed from the displacing means 108 and the displacing means 108 should be turned over to return the fluid 28 into initial position.

Now with reference to FIGS. 10–17 additional embodiments of the stopping means will be explained in connection with the centrifugation assembly comprising mostly the swing-out configuration.

Figure 10:
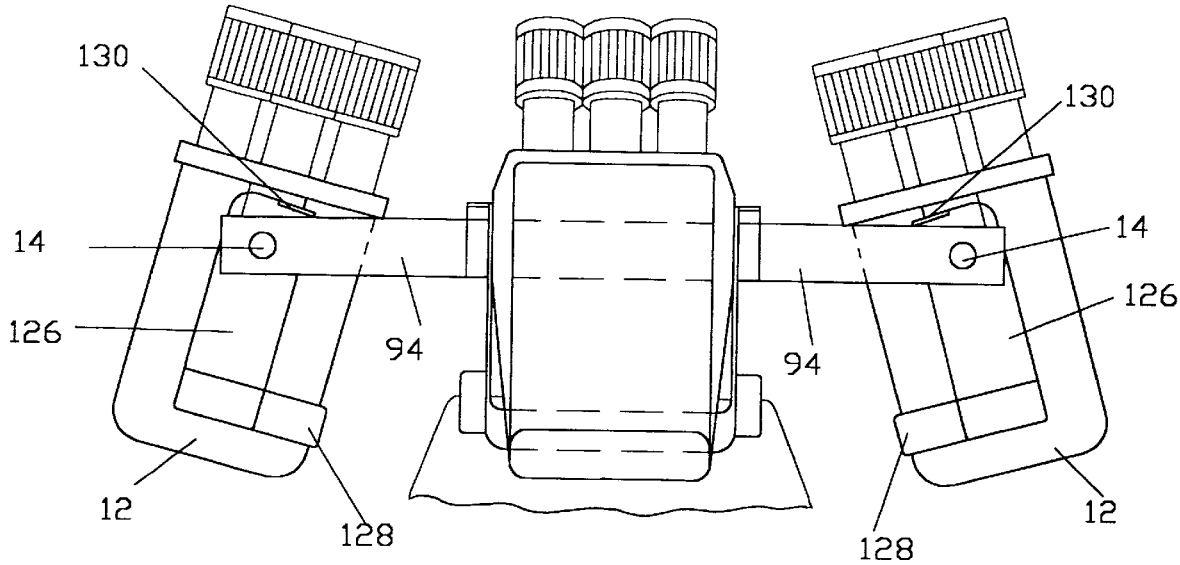
FIGS. 10–17 are various embodiments of a stopping means maintaining the angle of inclination of the tube during the first stage of the centrifugation process.
Figure 11:
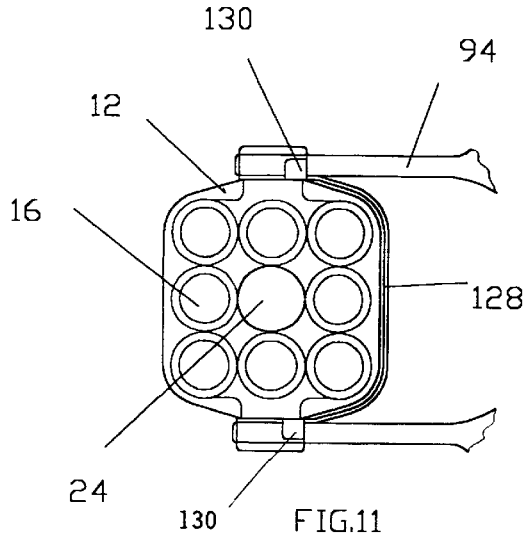

In FIGS. 10,11 one can see the stopping means configured as a bracket 126, which embraces the bucket 12 by its low portion 128. The bracket 126 is mounted on the pivoting axis 14 with possibility for pivoting independently of the bucket 12. Formed integrally with the upper part of the bracket 126 there is provided a support 130 capable to lean against the yoke 94 and thus to maintain the degree of inclination of the bucket 12 when it is pivoted in the first position with respect to the yoke 94. The displacing means 24 is also contained within the bucket 12 together with the sample tubes 16, so as to displace the common center of gravity of the bucket below the pivoting axis and to enable pivoting of the bucket into the second position.

Figure 12:
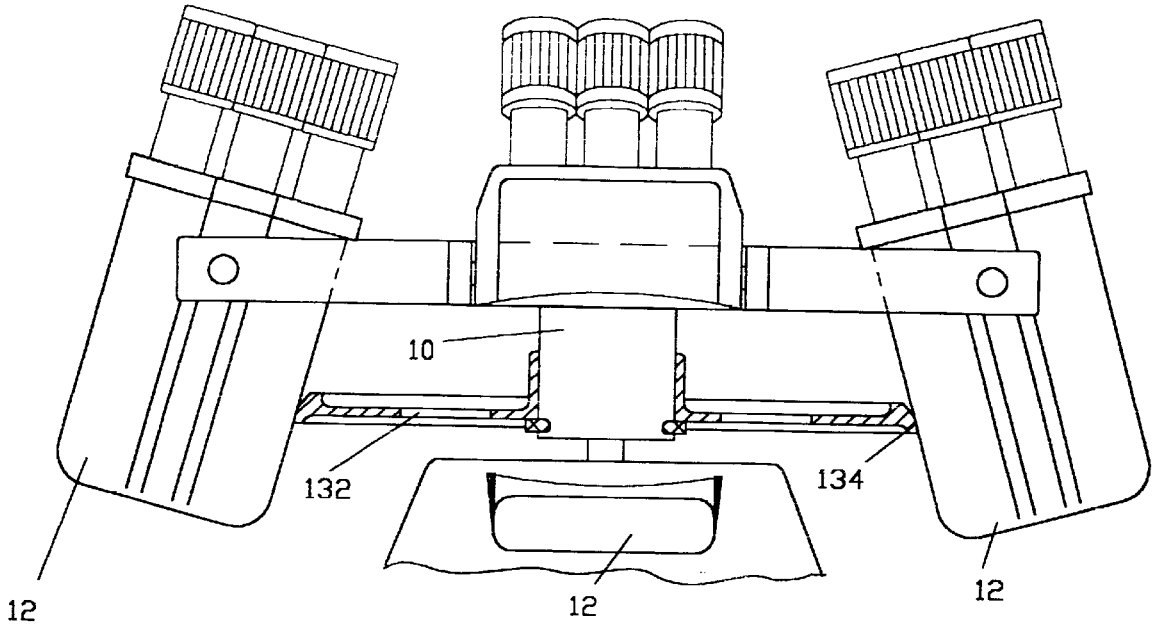
Figure 13:
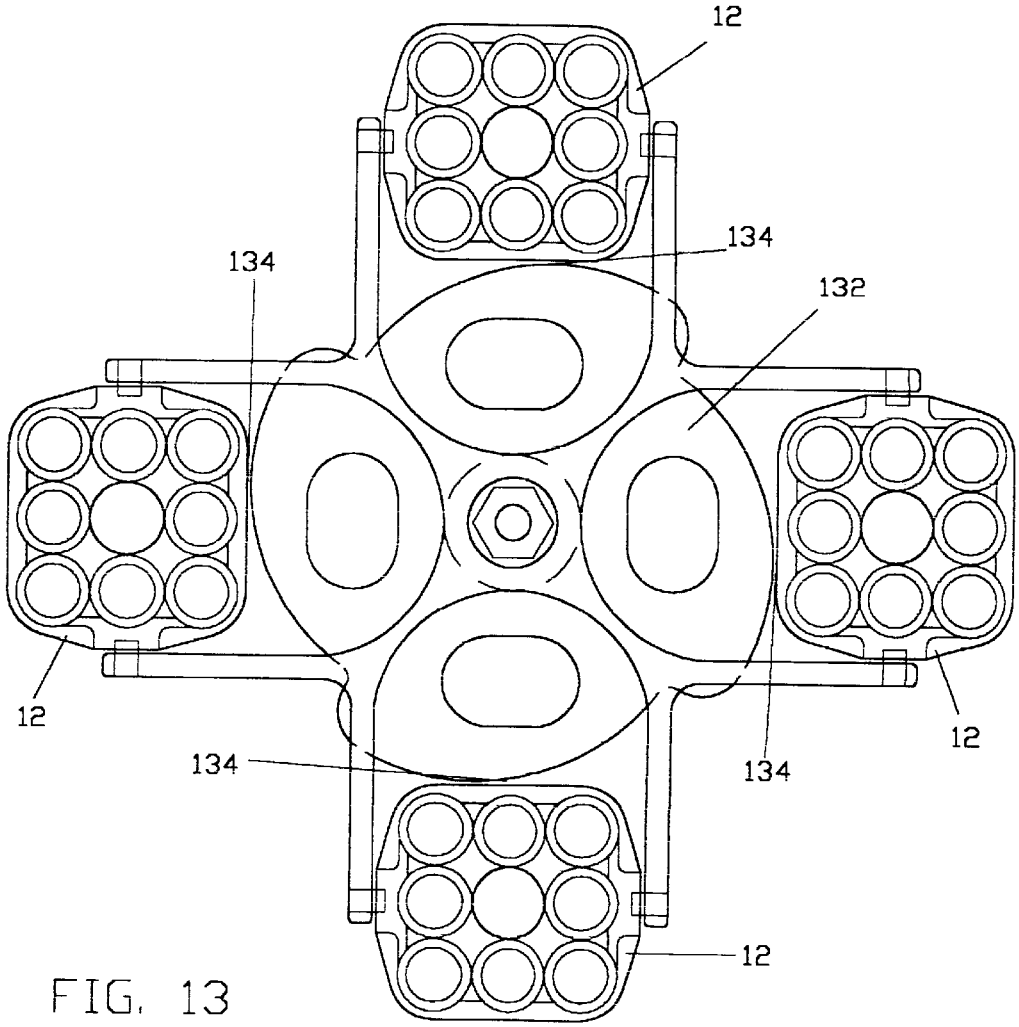

In FIGS. 12,13 it is shown still further embodiment of the stopping means comprising a flat cam 132 which is mounted on the rotor 10 with the possibility of being rotated about the axis of the rotor 10 by an appropriate rotating means (not shown). The cam's surface is perpendicular to the rotor axis and is configured with an arched contact surface 134 having a variable radius of curvature. As can be seen in FIG. 13 the contact surface 134 is leaning against the outwardly facing surface of the bucket 12 and thus maintains the degree of tubes inclination. In this position the phase separation is effected due to the Boycott effect. Upon completing this stage of the centrifugation run the bucket 12 can pivot in the second position in which the tube walls are aligned with the vector of the centrifugal force to achieve complete gel seal. The contact surface 134 of the cam does not prevent pivoting of the bucket 12 in the second position. Once the separation run is finished the cam 132 can be rotated within its plane in the initial position. The contact surface 134 can be configured so as to pivot the bucket 12 in vertical initial position.

Figure 14:
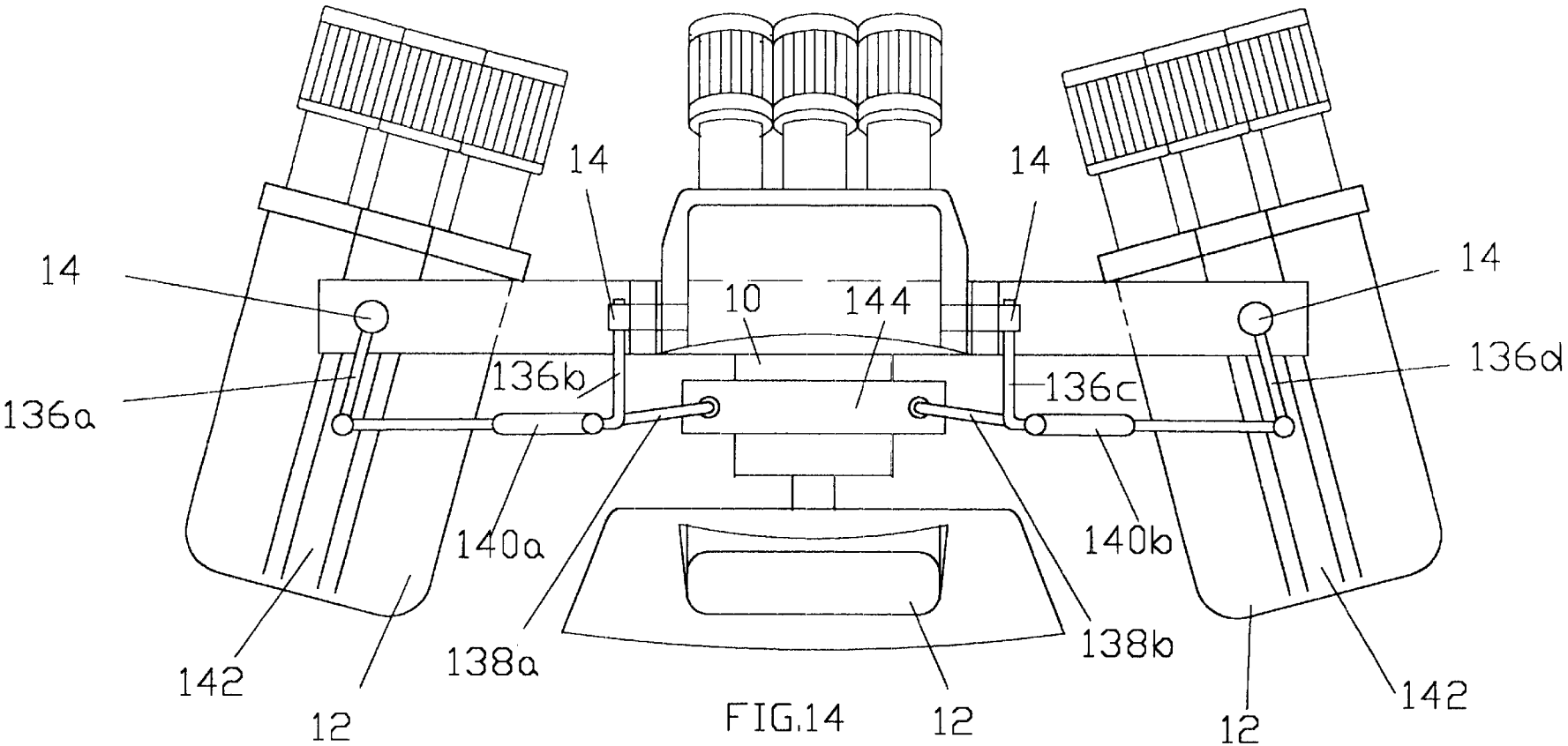

With reference to FIG. 14 there is shown the embodiment of the stopping means configured as a linkage system comprising linking arms 136*a–d*, 138*a–b* and operatively connected therewith an extension rods 140*a–b*. The arm 136 is pivotally connected with the axis 14 of the yoke 94. The outside surface of the bucket 12 is provided with a slot 142 configured in such a manner that the arm 136 resides within this slot 142 and can lean against it. By virtue of this provision it is possible to maintain the degree of inclination of the bucket 12. The arm 138 is connected with a load 144 which is mounted on the rotor 10 with possibility for longitudinal displacement along the rotor's axis. Once the load 144 is displaced the linkage system urges the bucket 12 to pivot and the degree of inclination of the bucket 12 can be maintained depending of the position of the load 144 with respect to the rotor 10.

Figure 15:
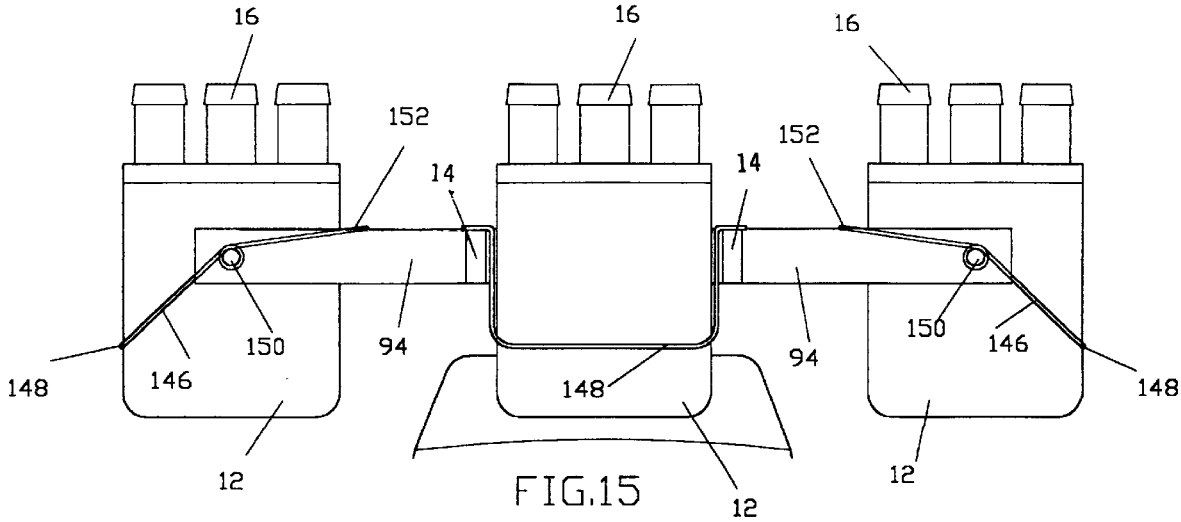

Still further embodiment of the stopping means is presented in FIG. 15. In this embodiment the stopping means comprises a resilient wire element 146. The wire element embraces by its first portion 148 the rear part of the bucket 12. Tightly coiled around the pivoting axis 14 of the yoke 94 is a middle portion 150 of the wire element configured as at least one turn. The opposite portion 152 of the wire element leans against the upper surface of the yoke 94. By virtue of this provision the degree of inclination of the bucket 12 with the tubes 16 inside can be maintained.

Figure 16:
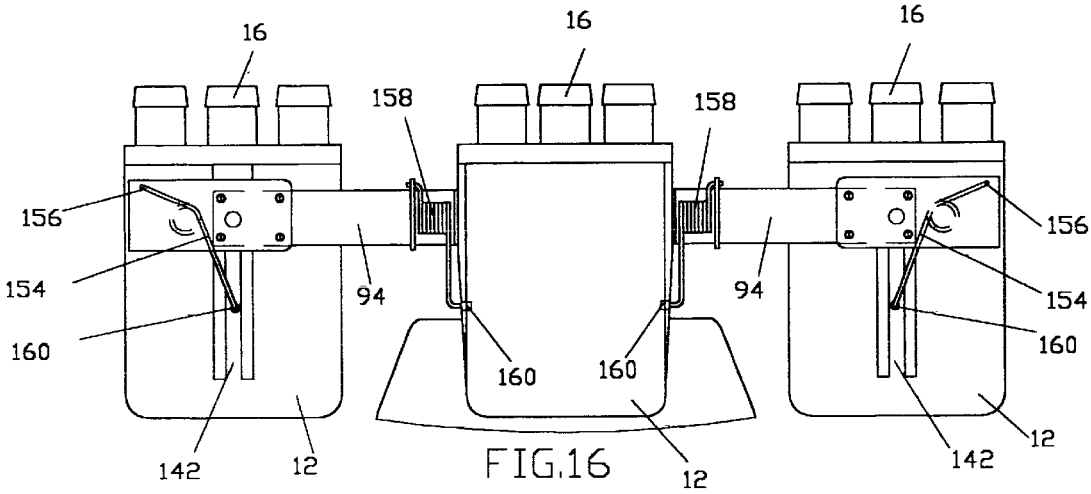

The embodiment of the stopping element shown in FIG. 16 comprises also a resilient wire element 154. The first portion 156 of the wire element is rigidly secured on the yoke 94 and the middle portion 158 of the wire element is coiled around the axis. The opposite portion 160 of the wire element is inserted within a slot 142 formed on the outside surface of the bucket 12. The wire element leans by its portion 160 against the slot 142 and resists to pivoting the bucket 12 in the horizontal position.

Figure 17:
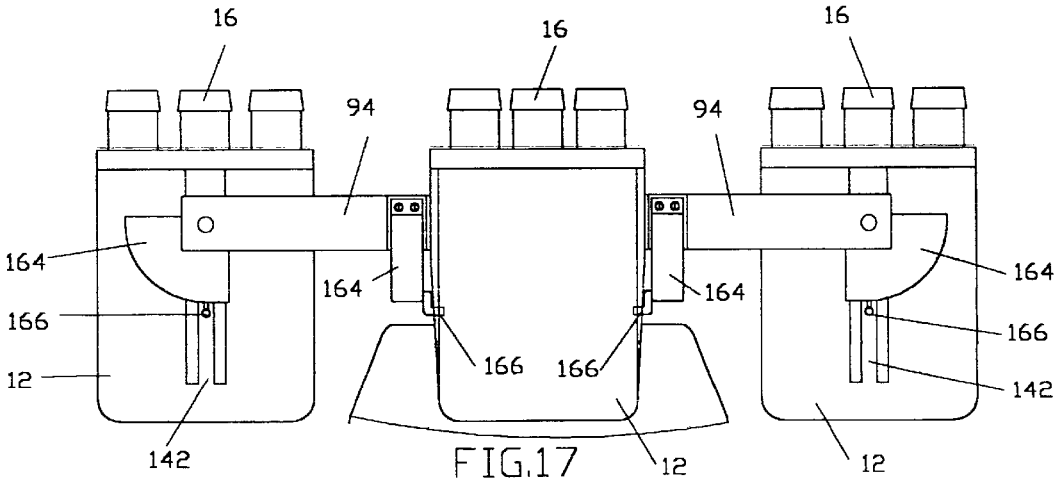

Referring to FIG. 17 there is presented still further embodiment of the stopping means which comprises a toothed sector 164 provided with a protrusion 166. The sector is mounted on the yoke 94. The protrusion 166 of the sector is inserted in the slot 142 formed on the outside surface of the bucket 12 and can lean against it. By virtue of this provision the position of the protrusion 166 defines and maintains the degree of inclination of the bucket 12 with the sample tubes 16.

Now with reference to FIGS. 18*a–b* and 19*a–b* additional embodiments of the centrifugation assembly are shown provided with a removing means for removing the caps from the tubes residing within the adapter of the bucket. The removing means is operated by virtue of the centrifugal force developed during the centrifugation run.

Figure 18B:
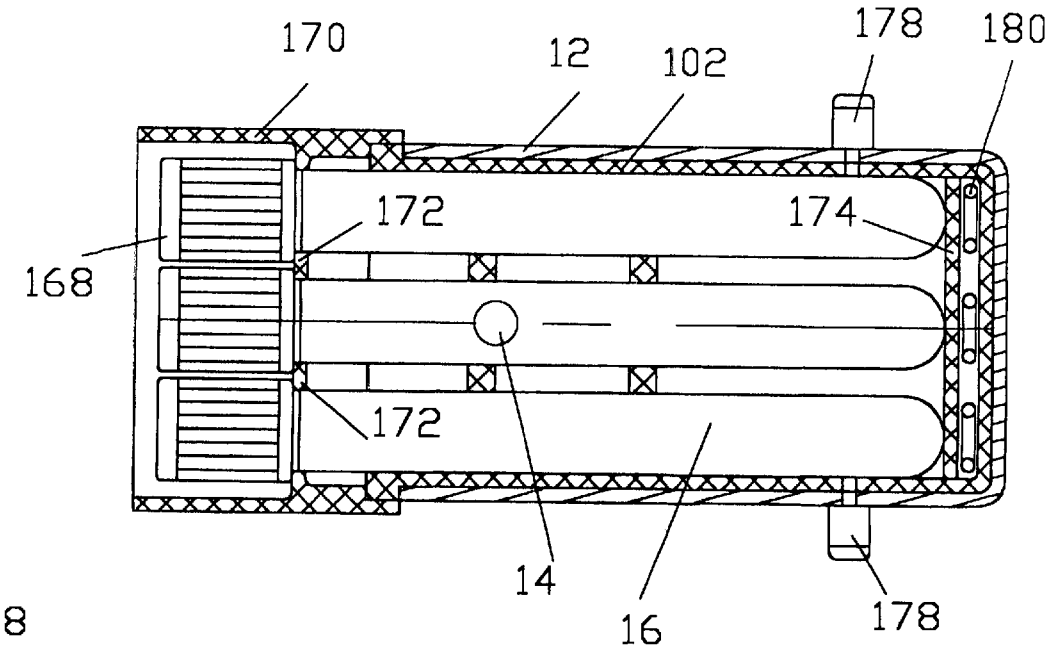
FIGS. 18*a* and 18*b* show schematically two positions of a holder provided with a removing means for removing the caps from the tubes.
Figure 18A:
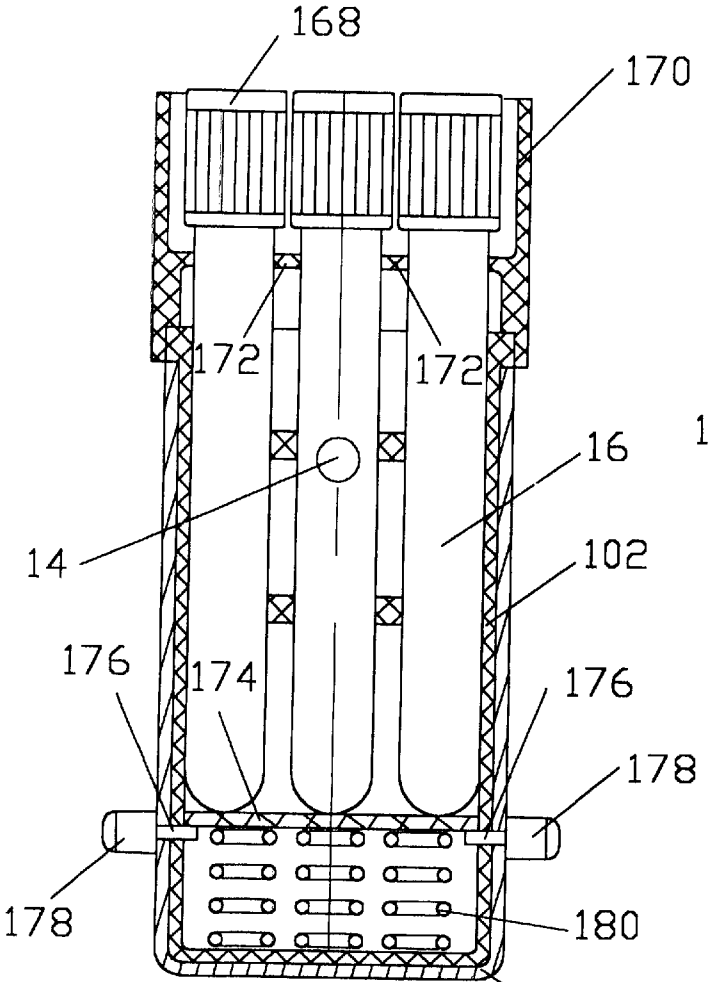

In the embodiment shown in FIG. 18*a* the holding means, for example a bucket 12 carries an adapter 102 containing sample tubes 16 closed by their respective caps 168. The bucket 12 is pivotally suspended on a pivoting axis 14 of the yoke of the swing-out centrifugation assembly (not shown). On the upper part of the bucket 12 there is secured a removable insert 170 having its middle section configured with a partition 172. The partition 172 is provided with a plurality of perforations to allow the passing of the tubes 16 there through, when the tubes 16 are loaded within the adapter 102. The diameter of the perforations slightly exceeds the outside diameters of the tubes 16 to enable insertion of the tubes 16 but is less than the outside diameter of the caps 168 so as to enable leaning thereof against the partition. The tubes 16 are resting within the adapter 102 on a supporting plate 174 which is displaceable along the adapter 102 between its uppermost position as shown in FIG. 18*a* towards the bottom part of the adapter. In the initial stage of the centrifugation run when the separation is effected due to the Boycott effect and the degree of inclination of the bucket 12 is maintained, the supporting plate 174 is retained in its uppermost position by a couple of fixation pins 176 protruding through the walls of the bucket 12 and of the adapter 102. The pins 176 are removable from the protruding position so as to enable release of the supporting plate 174 and its movement from the uppermost position to the lowermost position. The movement of the pins 176 from the protruding position and back into the protruding position can be controlled for example by a couple of respective solenoids 178. In the lower part of the adapter 102 there is provided a return spring 180 capable to return the support plate 174 with the tubes 16 into its initial uppermost position.

After the Boycott effect is over the solenoids 178 remove the pins 176 from the protruding position to relieve the supporting plate 174. Now the centrifugal force urges the supporting plate 174 and the tubes 16 to move further and to reach the lowermost position as shown in FIG. 18*b*. The bucket 12 and tubes 16 takes the second horizontal position. The tubes remain in this position until the gel seal is formed and separation is completed. It can be appreciated that during the final stages caps 168 become removed from the tubes 16 due to the leaning against the partition 172.

Now the assembly is stopped and spring 180 returns the tubes 16 in the uppermost position ready for removing from the bucket 12. The solenoid 178 urges the fixing pins 176 to protrude and to lock the uppermost position of the supporting plate 174 and the fresh sample tubes 16 closed by caps 168 are loaded within the bucket via the insert 170.

It should be understood that in this embodiment the displacing means is not loaded in the bucket together with the sample tubes. The common center of gravity is displaced in the second position by the movement of the tubes.

Figure 19B:
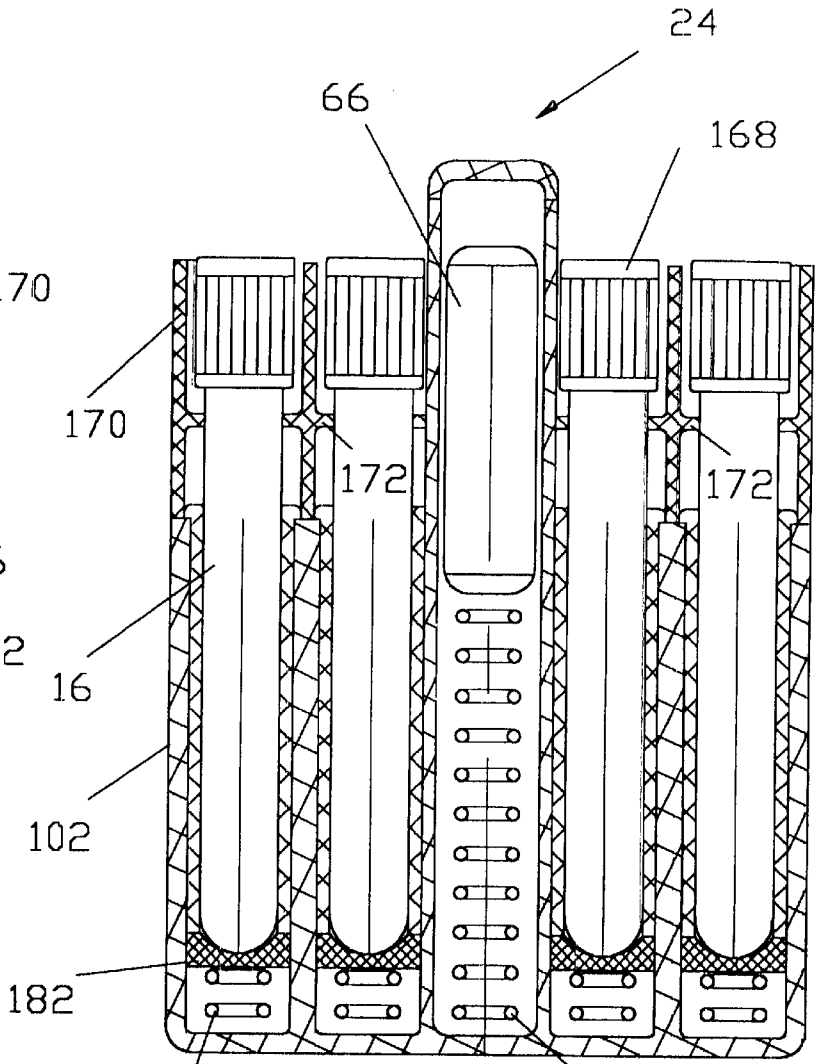
FIGS. 19*a* and 19*b* present various constructions of a holder provided with a removing means and with a displacing means.
Figure 19A:
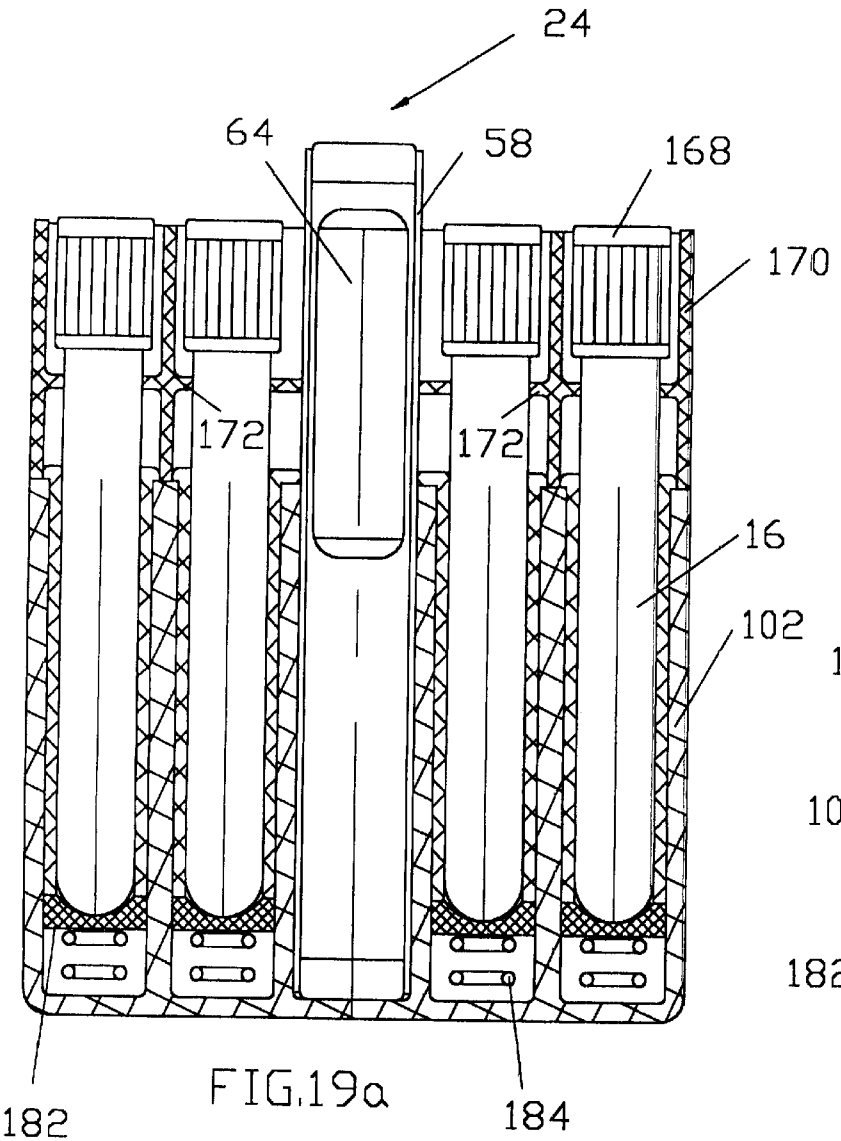

With reference to FIG. 19*a–b*, an adapter 102 is shown having a plurality of separated compartments for loading sample tubes 16 there into. Each compartment is provided with a dedicated supporting plate 182 and a spring 184 for returning both the plate 182 and the tube 16 resting thereon into the initial uppermost position. In the central part of the adapter 102 there is provided a dedicated compartment for putting there into a displacing means 24. The displacing means 24 is shown in FIG. 19*a* and it is formed as a closed cylinder 58 with a free mass 64, i.e. it is of the type requiring removal and turning over. In FIG. 19*b* is shown a displacing means 24 which is formed integrally with the adapter 102 and provided with a spring 72 for returning the free mass 66, formed as a valve, into initial position automatically. On the upper part of the adapter 102 there is fixed a removable insert 170 having its middle section configured with a partition 172. Caps 168 become removed from the tubes 16 due to the leaning against the partition 172 by virtue of the centrifugal force.

It should be understood that in the embodiments shown in FIGS. 18 and 19 there can be implemented either rapid separation or removal of the caps or both.

INDUSTRIAL APPLICABILITY

The assemblies of the present invention enables one to use standard swing-out bucket centrifuge like a fixed angle rotor centrifuge with different degrees of tube inclination. One can combine those embodiments as fixed angle rotor or as swing-out bucket or as both. The said assemblies may be provided with a removing means for removing the caps from the tubes residing within the holder.

It can be also realized that the embodiments of the present invention do not require any changes in the construction of the standard rotor and buckets and therefore can be easily used in various conventional swing-out centrifuges. The inventive centrifugation assembly can be easily mounted on the standard centrifuge and conveniently removed therefrom.

It will be also appreciated that the present invention is not limited to the above-described embodiments and that changes and modifications can be made by one ordinarily skilled in the art without deviation from the scope of the invention as will be defined below in the appended claims.

The features disclosed in the foregoing description, and/or in the following claims, and/or in the accompanying drawings may, both separately and in any combination thereof, be material for realizing the present invention in diverse forms thereof.

I claim:

1. A combined centrifugation assembly for rapid sample separation, said assembly comprising:

a rotor with a holding means for carrying at least one tube, said tube containing a blood sample and a gel separator, said holding means being pivotable about a pivoting axis with respect to the rotor, the holding means and the tube having a common center of gravity, the common center of gravity being variable during the separation process, a means for rotating the rotor about a rotor axis to produce a centrifugal force having its vector radiating from the rotor axis, said centrifugal force being capable:

a) to induce phase separation when the tube is pivoted in a first position in which the tube walls are inclined with respect to the vector of the centrifugal force and b) to allow complete gel seal when the tube is pivoted in a second position in which the tube walls are aligned with the vector of the centrifugal force, a displacing means for displacing the common center of gravity of the holding means with the tube carried thereby from a first location to a second location situated below the first location, and a stopping means for maintaining a selected degree of inclination of the tube when it is pivoted in said first position.

2. The centrifugation assembly as defined in claim 1, in which said assembly comprises a swing-out bucket centrifuge and fixed angle centrifuge, said rotor carrying a yoke for mounting the holding means, and said holding means comprising at least one bucket equipped with an adapter for receiving the tube, said bucket being mounted on the yoke for swinging with respect to the yoke about said pivoting axis.

3. The centrifugal assembly as defined in claim 2, wherein the tube has a cap and in which said holding means is provided with a removing means for removing the cap from the tube residing within the holding means, said removing means being movable by the centrifugal force.

4. The centrifugal assembly as defined in claim 3, in which said removing means is formed integrally with the displacing means, said removing means comprising:

a detachable insert connected to an upper part of the holding means, said insert being provided with a perforated partition transverse to the length of the tube, the diameter of at least one perforation of the partition fitting the outside diameter of the tube so as to allow insertion of the tube within the holding means through the perforation, and the cap having an outside diameter larger than the perforation diameter, a support plate for supporting the tube after being inserted in the holding means, said plate movable by the centrifugal force along the longitudinal axis of the holding means from an uppermost position to a lowermost position, a fixing means for preventing movement of the support plate and the tube by the centrifugal force from the uppermost position toward the lowermost position when the holding means is pivoted in the first position, a spring means for returning the support plate and the tube from the lowermost position into the uppermost position, whereby the tube is movable with the support plate by the centrifugal force toward the lowermost position until the cap leans against the partition so as to remove the cap from the tube.

5. The centrifugation assembly as defined in claim 4, in which said fixing means is electromagnetically controlled.

6. The centrifugal assembly as defined in claim 3, in which said removing means comprises:

a detachable insert which is fixed on an upper part of the holding means, a support plate for supporting the tube after insertion in the holding means, said plate being movable by the centrifugal force along the longitudinal axis of the holding means from an uppermost position to a lowermost position, and a spring means for returning the support plate and tube from the lowermost position into the uppermost position.

7. The centrifugal assembly as defined in claim 2, in which said displacing means is formed integrally with the adapter, said displacing means comprising:

a free mass in the adapter, moveable along the adapter, the adapter having a compartment for the mass and the outside diameter of the mass being less than the inside diameter of the compartment, defining a gap sufficient for flowing a fluid through the gap, and a spring in the compartment, bearing against the free mass and capable to return the mass from one extremity of the adapter to an opposite extremity in the absence of centrifugal force acting on the free mass against the spring.

8. The centrifugation assembly as defined in claim 1, in which said assembly comprises a high-speed centrifuge with said rotor rotating at high speed.

9. The centrifugation assembly as defined in claim 1, in which said displacing means comprises:

a closed cylindrical container insertable within the holding means, said container being filled with a fluid capable to flow from one extremity of the container to an opposite extremity thereof, said fluid being selected from at least one of the group comprising viscous liquids, suspensions, and loose particles.

10. The centrifugation assembly as defined in claim 9, in which said container is formed with a narrowing central portion.

11. The centrifugation assembly as defined in claim 9, in which said container is provided with a partition, said partition being fixedly secured in a middle part of the container.

12. The centrifugation assembly as defined in claim 9, in which said container has a spring loaded piston movable along the container and a valve, said valve being fixedly secured opposite to the piston in the middle part of the container, said valve having through going channels for flowing the fluid there through.

13. The centrifugal assembly as defined in claim 9, in which said container contains free mass movable within the container, the mass having an outside diameter less than the inside diameter of the container so as to define a gap sufficient for flow of the fluid.

14. The centrifugal assembly as defined in claim 13, in which said free mass is provided with a through going channel, and including a one-way valve closing said channel from one side of the mass and permitting flow from the opposite side of the mass.

15. The centrifugal assembly as defined in claim 13, in which said container is provided with a spring urging the mass to move from a lowermost extremity of the container to an uppermost-extremity, said container having a retaining means to retain the mass proximate to the uppermost extremity of the container.

16. The centrifugal assembly as defined in claim 1, in which said stopping means comprises a support formed integrally with an external portion of the holding means, said support being capable to lean against the rotor when the holding means is pivoted in said first position so as to maintain the degree of inclination of the tube.

17. The centrifugal assembly as defined in claim 1, in which said stopping means comprises a support formed integrally with the rotor, said support being capable to lean against the holding means when the holding means is pivoted in said first position so as to maintain the degree of inclination of the tube.

18. The centrifugal assembly as defined in claim 1, including an adapter configured to receive the tube and to be inserted in the holding means, and said stopping means comprising a supporting formed integrally with an upper portion of the adapter, said support protruding from the adapter towards the rotor, the rotor having a circular protrusion, said support being capable to lean against the circular protrusion on the rotor when the holding means is pivoted in said first position so as to maintain the degree of inclination of the tube.

19. The centrifugal assembly as defined in claim 1, in which said stopping means comprises a bracket embracing the holding means, the rotor including a yoke, and said bracket being pivotally mounted on the yoke and formed with a support capable to lean against the yoke when the tube holder is pivoted in said first position so as to maintain the degree of inclination of the tube.

20. The centrifugal assembly as defined in claim 1, in which said stopping means comprises a cam mounted on the rotor, said cam being provided with at least one contact surface capable to lean against the holding means when the holding means is pivoted in said first position so as to maintain the degree of inclination of the tube.

21. The centrifugal assembly as defined in claim 1, in which said stopping means comprises at least one linking arm and operatively connected extension rod, the rotor including a yoke pivotally supporting the holding means about a yoke axis, and said arm being pivotally connected to the axis of the yoke so as to swing about the axis together with the holding means, the holding means having a slot for receiving said arm, the rotor including a load and said extension rod being connected to the load mounted on the rotor, said load being displaceable along the rotor axis so as to pivot the arm, said arm being capable to lean against the slot when the holding means is pivoted so as to maintain the degree of inclination of the tube when pivoted in accordance with the position of the load.

22. The centrifugal assembly as defined in claim 1, in which the rotor includes a yoke supporting the holding means, and in which said stopping means comprises a resilient wire element, a first portion of the wire element being configured to embrace the holding means, a middle portion of the wire element being provided with at least one turn for coiling the wire element on the yoke and an opposite portion of the wire element being capable to lean against the yoke when the holding means is pivoted in said first position so as to maintain the degree of inclination of the tube.

23. The centrifugal assembly as defined in claim 1, in which the rotor includes a yoke supporting the holding means on a pivoting axis, and in which said stopping means comprises a resilient wire element, a first portion of the wire element being rigidly secured on the yoke, a middle portion being provided with at least one turn coiling the wire element around the pivoting axis of the yoke and an opposite portion of the wire element being inserted within a slot formed on the holding means, the opposite portion of the wire element being capable to lean against the slot when the holding means is pivoted in said first position so as to maintain the degree of inclination of the tube.

24. The centrifugal assembly as defined in claim 1, in which the rotor includes a yoke supporting the holding means about a pivoting axis, and said stopping means comprising a toothed sector mounted on the yoke, said sector having a protrusion and said holding means having a slot for receiving said protrusion, the protrusion being capable to maintain the degree of inclination of the tube when the bucket is pivoted in said first position.

25. The centrifugation assembly as defined in claim 1, including an adapter configured to receive the tube and to be inserted in the holding means, in which said displacing means is formed integrally with the holding means, said displacing means comprising:

a double-walled annular cylindrical container formed with annular closed interior, said interior containing a fluid capable to flow from one extremity of the container to an opposite extremity thereof, the diameter of an inner surface of the container fitting over an outside diameter of the adapter to allow inserting the adapter into the container, a partition with an opening arranged within the annular interior of the container, the opening provided with at least one valve, the valve being electromagnetically controlled.

26. A method for rapid sample separation by virtue of a centrifugation, said method comprising:

providing at least one tube with a blood sample, placing said tube within a centrifugation assembly having a rotor and a holding means for carrying the tube, said tube being placed in the holding means so as to be pivotable together with the holding means with respect to the rotor about a pivoting axis, the position of a common center of gravity of the holding means and the tube placed in the holding means being varied during the separation process, rotating the rotor about a rotor axis to produce a centrifugal force having a vector radiating from the rotor axis, effecting blood phase separation in the sample, when the tube rotates about the rotor and is pivoted in a first position in which walls of the tube are inclined with respect to the vector of the centrifugal force, displacing the common center of gravity of the holding means and the tube carried thereby from a first location into a second location situated below the first location, maintaining by a stopping means the degree of inclination of the tube, while the tube rotates as pivoted in the first position, and effecting complete gel seal when the center of gravity is displaced to said second location while the tube rotates as pivoted in a second position in which the tube walls are aligned with the vector of the centrifugal force.

27. The method as defined in claim 26, in which said centrifugation is effected by a swing-out bucket centrifuge as said holding means.

28. The method as defined in claim 26, in which said centrifugation is effected by a high-speed centrifuge.

29. The method as defined in claim 26, in which the step of displacing the common center of gravity is effected by a closed container on the holding means, filled with a fluid capable to flow from one extremity of the container to an opposite extremity thereof under the influence of centrifugal force, thus moving the common center of gravity by movement of the fluid.

30. The method as defined in claim 29, in which the flow of the fluid within the container is effected in a controllable manner.

31. The method as defined in claim 26, in which said displacing of the common center of gravity is effected by a free mass within the holding means such that the mass is movable from one extremity of the holding means to an opposite extremity thereof.

32. The method as defined in claim 26, in which the step of displacing the common center of gravity is effected by displacing heavy parts of the sample inside the tube.

33. The method as defined in claim 26, in which the step of displacing the common center of gravity is effected by movement of the tube within the holding means under the influence of centrifugal force.

34. The method as defined in claim 26, in which said first location of the common center of gravity is above the pivoting axis of the holding means.

35. A method for removing caps from tubes residing within a tube holder in a centrifugation process, said method comprising:

providing at least one tube with a blood sample and a cap, placing said tube on a support plate within a centrifugation assembly having a rotor and a holder for carrying the tube, rotating the rotor about a rotor axis to produce a centrifugal force having its vector radiating from the rotor axis, displacing the tube along with the support plate relative to the holder by the centrifugal force, toward a lowermost tube position, engaging the cap against a detachable insert on the holder so as to remove the cap from the tube, and returning the support plate and the tube from the lowermost tube position into an uppermost position, after stopping the rotor.

* * * * *